US010626486B2

(12) United States Patent
Mizutani et al.

(10) Patent No.: US 10,626,486 B2
(45) **Date of Patent: *Apr. 21, 2020**

(54) STAINLESS STEEL AND PRODUCTION METHOD THEREFOR

(71) Applicant: JFE STEEL CORPORATION, Chiyoda-ku, Tokyo (JP)

(72) Inventors: Akito Mizutani, Tokyo (JP); Masataka Yoshino, Tokyo (JP); Mitsuyuki Fujisawa, Tokyo (JP); Ayako Ta, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 276 days.

This patent is subject to a terminal disclaimer.

(21) Appl. No.: 15/533,499

(22) PCT Filed: Jul. 2, 2015

(86) PCT No.: PCT/JP2015/003334
§ 371 (c)(1),
(2) Date: Jun. 6, 2017

(87) PCT Pub. No.: WO2016/092713
PCT Pub. Date: Jun. 16, 2016

(65) Prior Publication Data

US 2017/0349984 A1 Dec. 7, 2017

(30) Foreign Application Priority Data

Dec. 11, 2014 (JP) ..... 2014-251176

(51) Int. Cl.

| | |
|---|---|
| ***C22C 38/40*** | (2006.01) |
| ***C21D 9/46*** | (2006.01) |
| ***C22C 38/54*** | (2006.01) |
| ***C22C 38/00*** | (2006.01) |
| ***C22C 38/52*** | (2006.01) |
| ***C22C 38/42*** | (2006.01) |
| ***C21D 8/02*** | (2006.01) |
| ***C22C 38/50*** | (2006.01) |
| ***C21D 6/00*** | (2006.01) |
| ***C22C 38/44*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C22C 38/40* (2013.01); *C21D 6/002* (2013.01); *C21D 8/0263* (2013.01); *C21D 8/0273* (2013.01); *C21D 9/46* (2013.01); *C22C 38/00* (2013.01); *C22C 38/001* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/50* (2013.01); *C22C 38/52* (2013.01); *C22C 38/54* (2013.01); *C21D 8/0226* (2013.01); *C21D 8/0236* (2013.01); *C21D 2211/005* (2013.01); *C21D 2211/008* (2013.01)

(58) Field of Classification Search

CPC ..... C22C 38/40; C21D 6/002
USPC ..... 420/34
See application file for complete search history.

(56) References Cited

U.S. PATENT DOCUMENTS

| | | | | |
|---|---|---|---|---|
| 6,113,710 | A * | 9/2000 | Kato | C21D 8/0405 148/325 |
| 10,000,824 | B2 * | 6/2018 | Yoshino | C21D 6/002 |
| 2001/0003293 | A1 | 6/2001 | Hirata et al. | |
| 2014/0294661 | A1 | 10/2014 | Fukuda et al. | |
| 2016/0333439 | A1 * | 11/2016 | Yoshino | C21D 9/48 |
| 2016/0369368 | A1 | 12/2016 | Yoshino et al. | |
| 2017/0275725 | A1 * | 9/2017 | Mizutani | B01J 32/00 |
| 2018/0171430 | A1 * | 6/2018 | Yoshino | C21D 9/46 |
| 2018/0265951 | A1 * | 9/2018 | Yoshino | C22C 38/18 |

FOREIGN PATENT DOCUMENTS

| | | | |
|---|---|---|---|
| CN | 106414783 | A | 2/2017 |
| EP | 1113084 | A1 | 7/2001 |
| EP | 3093362 | A1 | 11/2016 |
| EP | 3098330 | A1 | 11/2016 |
| JP | H09111354 | A | 4/1997 |
| JP | 09263902 | A * | 10/1997 |
| JP | H09263902 | A | 10/1997 |
| JP | H10219407 | A | 8/1998 |
| JP | 2001089815 | A | 4/2001 |

(Continued)

OTHER PUBLICATIONS

Sep. 20, 2017, Extended European Search Report issued by the European Patent Office in the corresponding European Patent Application No. 15867791.4.

(Continued)

*Primary Examiner* — Weiping Zhu

(74) *Attorney, Agent, or Firm* — Kenja IP Law PC

(57) ABSTRACT

Stainless steel that has excellent formability and ridging resistance and can be produced with high productivity is provided. The stainless steel comprises: a chemical composition containing, in mass %, C: 0.005% to 0.050%, Si: 0.01% to 1.00%, Mn: 0.01% to 1.0%, P: 0.040% or less, S: 0.010% or less, Cr: 15.5% to 18.0%, Ni: 0.01% to 1.0%, Al: 0.001% to 0.10%, and N: 0.005% to 0.06%, with a balance being Fe and incidental impurities; and a microstructure containing a martensite phase of 1% to 10% in volume fraction with respect to a whole volume of the microstructure.

2 Claims, No Drawings

(56) References Cited

FOREIGN PATENT DOCUMENTS

| | | | |
|---|---|---|---|
| JP | 2001316774 | A | 11/2001 |
| JP | 2001316775 | A | 11/2001 |
| JP | 2003201547 | A | 7/2003 |
| JP | 2004223536 | A | 8/2004 |
| JP | 2008163359 | A | 7/2008 |
| JP | 4744033 | B2 | 8/2011 |
| JP | 5505575 | B1 | 5/2014 |
| WO | 2013080518 | A1 | 6/2013 |
| WO | 2014147655 | A1 | 9/2014 |
| WO | 2015105045 | A1 | 7/2015 |
| WO | 2015105046 | A1 | 7/2015 |

OTHER PUBLICATIONS

Aug. 9, 2018, Office Action issued by the Korean Intellectual Property Office in the corresponding Korean Patent Application No. 10-2017-7015144 with English language concise statement of relevance.

Oct. 9, 2018, Office Action issued by the State Intellectual Property Office in the corresponding Chinese Patent Application No. 201580067087.7 with English language concise statement of relevance.

I. M. Bernstein et al., "Residual and Minor Elements in Stainless Steels", Handbook of Stainless Steels, Jan. 1, 1977, pp. 14-1 to 14-14, XP002430954.

Jul. 26, 2018, Communication pursuant to Article 94(3) EPC issued by the European Patent Office in the corresponding European Patent Application No. 15867791.4.

Oct. 6, 2015, International Search Report issued in the International Patent Application No. PCT/JP2015/003334.

Mar. 29, 2018, Office Action issued by the State Intellectual Property Office in the corresponding Chinese Patent Application No. 201580067087.7 with English language Search Report.

Mar. 4, 2019, Office Action issued by the State Intellectual Property Office in the corresponding Chinese Patent Application No. 201580067087.7 with English language concise statement of relevance.

* cited by examiner

STAINLESS STEEL AND PRODUCTION METHOD THEREFOR

TECHNICAL FIELD

The disclosure relates to stainless steel, and particularly to stainless steel having excellent formability and ridging resistance.

BACKGROUND

Ferritic stainless steel, such as SUS430, is economical and has excellent anti-corrosion property, and so has been used in home appliances, kitchen instruments, etc. In recent years, the use of ferritic stainless steel in cooking utensils compatible with induction heating (IH) has been on the increase, as ferritic stainless steel is magnetic. Cooking wares such as pans are often made by bulging or drawing, and sufficient elongation and mean Lankford value (((r-value in the rolling direction)+2×(r-value in the direction of 45° to the rolling direction)+(r-value in the direction orthogonal to the rolling direction))/4, hereafter also referred to as "mean r-value") are needed in order to form a predetermined shape.

In the case of performing bulging or drawing, it is important that the material of the steel sheet has small anisotropy. For example, in the case of bulging, even when the mean elongation after fracture (((elongation after fracture in the rolling direction)+2×(elongation after fracture in the direction of 45° to the rolling direction)+(elongation after fracture in the direction orthogonal to the rolling direction))/4, hereafter also referred to as "mean El") of the steel sheet is large, its forming limit is limited by the elongation after fracture in the direction in which the elongation after fracture is smallest in the steel sheet. Accordingly, for stable bulging, the in-plane anisotropy of elongation after fracture (the absolute value of ((elongation after fracture in the rolling direction)−2×(elongation after fracture in the direction of 45° to the rolling direction)+(elongation after fracture in the direction orthogonal to the rolling direction))/2, hereafter also referred to as "|ΔEl|") needs to be small.

In the case of drawing, earing caused by the in-plane anisotropy of r-value (the absolute value of ((r-value in the rolling direction)−2×(r-value in the direction of 45° to the rolling direction)+(r-value in the direction orthogonal to the rolling direction))/2, hereafter also referred to as "|Δr|") of the steel sheet occurs. Earing is greater when the steel sheet has larger |Δr|. Accordingly, in the case of drawing the steel sheet having large |Δr|, it is necessary to increase the blank diameter before press forming, which causes a lower production yield rate. Hence, |Δr| needs to be small.

Surface appearance also significantly affects the commercial value of cooking pans and the like. Typically, when forming ferritic stainless steel into a product, surface roughness called ridging appears, degrading the surface appearance of the formed product. In the case where excessive ridging occurs, polishing is required after the formation to remove the roughness, which increases production cost. Ridging therefore needs to be reduced. Ridging derives from an aggregate (hereafter also referred to as "ferrite colony" or "colony") of ferrite grains having similar crystal orientations. It is believed that a coarse columnar crystalline generated during casting is elongated by hot rolling, and the elongated grains or grain group remains even after hot-rolled sheet annealing, cold rolling, and cold-rolled sheet annealing, thus forming a colony.

In view of the aforementioned problems, for example, JP 4744033 B2 (PTL 1) discloses "a production method for a ferritic stainless steel sheet having excellent workability, comprising: hot rolling a slab of ferritic stainless steel having γmax of 20 or more and less than 70 and then quenching it; coiling the obtained hot rolled sheet at less than 600° C., to obtain a dual phase microstructure of ferrite phase and martensite phase containing a large amount of carbon solid solution; performing intermediate cold rolling at a rolling ratio of 20% to 80% on the dual phase microstructure without hot-rolled sheet annealing, to accumulate a strain in the ferrite phase; then performing long-time annealing (batch annealing) using a box furnace to recrystallize the ferrite phase in which the strain has accumulated and simultaneously recrystallize the martensite phase containing a large amount of carbon solid solution into the ferrite phase to randomize the texture; and further finish cold rolling and recrystallization annealing it to form a ferrite single-phase microstructure". Here, γmax=420C−11.5Si+7Mn+23Ni−11.5Cr−12Mo+9Cu−49Ti−50Nb−52Al+470N+189. C, Si, Mn, Ni, Cr, Mo, Cu, Ti, Nb, Al, and N denote the contents (mass %) of the respective elements.

JP H9-111354 A (PTL 2) discloses "a production method for an aluminum-containing ferritic stainless steel sheet having excellent ridging resistance and press formability and favorable surface characteristics, comprising: heating, at 1100° C. to 1250° C., a billet having a chemical composition containing, in wt. %, C: 0.02% to 0.05%, Si: 1.0% or less, Mn: 1.5% or less, N: 0.02% to 0.05%, Cr: 15% to 18%, and Al: 0.10% to 0.30%, with a balance being Fe and incidental impurities; then hot rolling the billet and ending the hot rolling at a final pass delivery temperature of 950° C. or more; cooling the hot rolled sheet at a cooling rate of 20° C./s to 80° C./s to a coiling temperature of 500° C. to 650° C. so that the hot rolled sheet is made of multi-phase of ferrite phase and martensite phase and has martensite of 10% to 20% in volume fraction; annealing the obtained hot rolled sheet in a temperature range of 850° C. to 980° C. for 180 seconds to 300 seconds; then performing hot-rolled sheet annealing of quenching the steel sheet at a cooling rate of 15° C./s or more; and further cold rolling and final annealing the hot-rolled and annealed sheet to form a ferrite single-phase microstructure".

CITATION LIST

Patent Literatures

PTL 1: JP 4744033 B2
PTL 2: JP H9-111354 A

SUMMARY

Technical Problem

However, the method described in PTL 1 does not take into consideration the in-plane anisotropy of elongation after fracture. Besides, cold rolling needs to be performed after hot rolling without annealing in the steel sheet production, which increases the rolling load. Furthermore, long-time box annealing and two cold rolling steps need to be performed, which decreases productivity.

The method described in PTL 2 needs Al content of 0.10 wt. % to 0.30 wt. %. This tends to cause surface defects such as scabs due to a large amount of $Al_2O_3$ formed during casting.

It could be helpful to provide stainless steel that has excellent formability and ridging resistance and can be produced with high productivity, and a production method therefore.

Here, "excellent formability" means that the mean elongation after fracture (mean El) calculated using the following Expression (1) in a tensile test according to JIS Z 2241 is 25% or more, the in-plane anisotropy of elongation after fracture |ΔEl| calculated using the following Expression (2) is 3.0% or less, the mean r-value calculated using the following Expression (3) when adding a strain of 15% in a tensile test according to JIS Z 2241 is 0.70 or more, and the in-plane anisotropy of r-value |Δr| calculated using the following Expression (4) is 0.30 or less:

$$\text{mean } El=(El_L+2\times El_D+El_C)/4 \quad (1)$$

$$|\Delta El|=|(El_L-2\times El_D+El_C)/2| \quad (2)$$

$$\text{mean } r\text{-value}=(r_L+2\times r_D+r_C)/4 \quad (3)$$

$$|\Delta r|=|(r_L-2\times r_D+r_C)/2| \quad (4)$$

where $El_L$ and $r_L$ are the elongation after fracture and r-value obtained from a test piece collected in the rolling direction, $El_D$ and $r_D$ are the elongation after fracture and r-value obtained from a test piece collected in the direction of 45° to the rolling direction, and $El_C$ and $r_C$ are the elongation after fracture and r-value obtained from a test piece collected in the direction orthogonal to the rolling direction.

Meanwhile, "excellent ridging resistance" means that the ridging height measured by the following method is 2.5 μm or less. First, a JIS No. 5 tensile test piece is collected in the rolling direction. After polishing the surface of the collected test piece using #600 emery paper, a tensile strain of 20% is added to the test piece. The arithmetic mean waviness Wa defined in JIS B 0601 (2001) is then measured by a surface roughness meter on the polished surface at the center of the parallel portion of the test piece, in the direction orthogonal to the rolling direction. The measurement conditions are a measurement length of 16 mm, a high-cut filter wavelength of 0.8 mm, and a low-cut filter wavelength of 8 mm. This arithmetic mean waviness is set as the ridging height.

Solution to Problem

We repeatedly conducted intensive study. In particular, to improve productivity, we intensively studied a method for ensuring excellent formability and ridging resistance not by long-time hot-rolled sheet annealing through currently commonly used box annealing (batch annealing) but by short-time hot-rolled sheet annealing using a continuous annealing furnace.

As a result, we discovered that, even in the case of performing short-time hot-rolled sheet annealing using a continuous annealing furnace, a ferrite colony formed in the casting stage can be effectively destroyed by generating martensite phase during hot-rolled sheet annealing and performing cold rolling in this state.

We also discovered that both excellent formability and excellent ridging resistance can be achieved by subjecting the cold rolled sheet obtained in this way to cold-rolled sheet annealing under an appropriate condition to make the microstructure of the cold-rolled and annealed sheet a dual phase microstructure of martensite phase and ferrite phase and appropriately controlling the volume fraction of the martensite phase with respect to the whole volume of the microstructure.

The disclosure is based on the aforementioned discoveries and further studies.

We provide the following:

1. A stainless steel comprising: a chemical composition containing (consisting of), in mass %, C: 0.005% to 0.050%, Si: 0.01% to 1.00%, Mn: 0.01% to 1.0%, P: 0.040% or less, S: 0.010% or less, Cr: 15.5% to 18.0%, Ni: 0.01% to 1.0%, Al: 0.001% to 0.10%, and N: 0.005% to 0.06%, with a balance being Fe and incidental impurities; and a microstructure containing a martensite phase of 1% to 10% in volume fraction with respect to a whole volume of the microstructure.

2. The stainless steel according to 1., wherein the chemical composition further contains, in mass %, one or more selected from Cu: 0.1% to 1.0%, Mo: 0.1% to 0.5%, and Co: 0.01% to 0.5%.

3. The stainless steel according to 1. or 2., wherein the chemical composition further contains, in mass %, one or more selected from V: 0.01% to 0.25%, Ti: 0.001% to 0.05%, Nb: 0.001% to 0.05%, Ca: 0.0002% to 0.0020%, Mg: 0.0002% to 0.0050%, B: 0.0002% to 0.0050%, and REM: 0.01% to 0.10%.

4. The stainless steel according to any one of 1. to 3., wherein mean elongation after fracture is 25% or more, in-plane anisotropy of elongation after fracture |ΔEl| is 3% or less, mean Lankford value is 0.70 or more, in-plane anisotropy of Lankford value |Δr| is 0.30 or less, and ridging height is 2.5 μm or less.

5. A method for producing the stainless steel according to any one of 1. to 4., the method comprising: hot rolling a steel slab having the chemical composition according to any one of 1. to 3. into a hot rolled sheet; performing hot-rolled sheet annealing of holding the hot rolled sheet in a temperature range of 900° C. or more and 1050° C. or less for 5 seconds to 15 minutes, to form a hot-rolled and annealed sheet; cold rolling the hot-rolled and annealed sheet into a cold rolled sheet; and performing cold-rolled sheet annealing of holding the cold rolled sheet in a temperature range of 850° C. or more and 950° C. or less for 5 seconds to 5 minutes.

Advantageous Effect

It is thus possible to obtain stainless steel having excellent formability and ridging resistance.

Such stainless steel is very advantageous in terms of productivity, as it can be produced not by long-time hot-rolled sheet annealing through box annealing (batch annealing) but by short-time hot-rolled sheet annealing using a continuous annealing furnace.

DETAILED DESCRIPTION

The following describes one of the disclosed embodiments in detail.

The reasons why the stainless steel according to the disclosure has excellent formability and ridging resistance are described first.

To improve the ridging resistance of stainless steel, it is effective to destroy a ferrite colony, which is an aggregate of crystal grains having similar crystal orientations.

We conducted repeated study to ensure excellent formability and ridging resistance not by long-time hot-rolled sheet annealing through currently commonly used box annealing (batch annealing) but by short-time hot-rolled sheet annealing using a continuous annealing furnace, for productivity. As a result, we discovered the following; Heating to the dual phase temperature region of the ferrite phase and austenite phase during hot-rolled sheet annealing facilitates recrystallization and also generates the austenite phase, which secures a predetermined amount of martensite phase after the hot-rolled sheet annealing. The ferrite colony is destroyed efficiently by cold rolling the hot-rolled and annealed sheet which includes the predetermined amount of martensite phase, since a rolling strain is effectively added to the ferrite phase during cold rolling.

We also discovered that, by heating the cold rolled sheet obtained in this way to the ferrite-austenite dual phase region and cold-rolled sheet annealing the cold rolled sheet so that an appropriate amount of martensite phase remains and/or is generated, excessive development of texture in the rolling direction is suppressed and the in-plane anisotropy of r-value and elongation after fracture in the steel sheet after final annealing is reduced. We further discovered that, by performing the aforementioned cold-rolled sheet annealing to facilitate recrystallization and generate austenite phase (which transforms to martensite phase after cooling), the ferrite colony can be destroyed more effectively.

In the case where the volume fraction of the martensite phase increases to a predetermined fraction or more, however, strength increases and elongation after fracture decreases significantly. We accordingly conducted detailed study on such a volume fraction of the martensite phase that contributes to predetermined formability and ridging resistance.

As a result, we discovered that, by controlling the volume fraction of the martensite phase to be in the range of 1% to 10% with respect to the whole volume of the microstructure, predetermined formability and ridging resistance can be attained without a decrease in elongation after fracture caused by an increase in steel sheet strength.

In the cold-rolled sheet annealing, the recrystallization of the ferrite phase and martensite phase into which the strain has been introduced by the cold rolling takes place. Here, it is important to cause an appropriate amount of martensite phase generated by the hot-rolled sheet annealing to remain or an appropriate amount of austenite phase (which transforms to martensite phase after cooling) to be generated in the cold-rolled sheet annealing, as mentioned above.

In detail, the presence of an appropriate amount of martensite phase or austenite phase during the cold-rolled sheet annealing suppresses preferential growth of ferrite crystal grains in the rolling direction. To achieve this effect, the volume fraction of the martensite phase in the steel sheet after final annealing needs to be 1% or more with respect to the whole volume of the microstructure. If the volume fraction of the martensite phase is more than 10%, excessive martensite phase content causes the steel sheet to harden, making it impossible to attain predetermined mean El. The volume fraction of the martensite phase is therefore in the range of 1% to 10% with respect to the whole volume of the microstructure. The volume fraction of the martensite phase is preferably 1% or more and 5% or less. The microstructure other than the martensite phase is the ferrite phase.

The reasons for limiting the chemical composition of the stainless steel according to the disclosure are described next. While the unit of the content of each element in the chemical composition is "mass %," the unit is hereafter simply expressed by "%" unless otherwise specified.

C: 0.005% to 0.050%

C has an effect of facilitating the generation of the austenite phase and expanding the dual phase temperature region of the ferrite phase and the austenite phase. To achieve this effect, the C content needs to be 0.005% or more. If the C content is more than 0.050%, the steel sheet hardens and predetermined mean El cannot be attained. The C content is therefore in the range of 0.005% to 0.050%. The C content is preferably 0.008% or more. The C content is preferably 0.025% or less. The C content is further preferably 0.010% or more. The C content is further preferably 0.020% or less.

Si: 0.01% to 1.00%

Si is an element that functions as a deoxidizer in steelmaking. To achieve this effect, the Si content needs to be 0.01% or more. If the Si content is more than 1.00%, the steel sheet hardens and predetermined mean El cannot be attained. Besides, surface scale formed during annealing becomes firm and pickling is difficult, which is not preferable. The Si content is therefore in the range of 0.01% to 1.00%. The Si content is preferably 0.10% or more. The Si content is preferably 0.75% or less. The Si content is further preferably 0.10% or more. The Si content is further preferably 0.30% or less.

Mn: 0.01% to 1.0%

Mn has an effect of facilitating the generation of the austenite phase and expanding the dual phase temperature region of the ferrite phase and the austenite phase during annealing, as with C. To achieve this effect, the Mn content needs to be 0.01% or more. If the Mn content is more than 1.0%, the amount of MnS generated increases, leading to lower anti-corrosion property. The Mn content is therefore in the range of 0.01% to 1.0%. The Mn content is preferably 0.50% or more. The Mn content is preferably 1.0% or less. The Mn content is further preferably 0.60% or more. The Mn content is further preferably 0.90% or less. The Mn content is still further preferably 0.75% or more. The Mn content is still further preferably 0.85% or less.

P: 0.040% or less

P is an element that promotes intergranular fracture by grain boundary segregation, and so is desirably low in content. The upper limit of the P content is 0.040%. The P content is preferably 0.030% or less. The P content is further preferably 0.020% or less. The lower limit of the P content is not particularly limited, but is about 0.010% in terms of production cost and the like.

S: 0.010% or less

S is an element that is present as a sulfide inclusion such as MnS and decreases ductility, corrosion resistance, etc. The adverse effects are noticeable particularly in the case where the S content is more than 0.010%. Accordingly, the S content is desirably as low as possible. The upper limit of the S content is 0.010%. The S content is preferably 0.007% or less. The S content is further preferably 0.005% or less. The lower limit of the S content is not particularly limited, but is about 0.001% in terms of production cost and the like.

Cr: 15.5% to 18.0%

Cr is an element that has an effect of forming a passive layer on the steel sheet surface and improving corrosion resistance. To achieve this effect, the Cr content needs to be 15.5% or more. If the Cr content is more than 18.0%, the generation of the austenite phase during annealing is insufficient, making it impossible to attain predetermined material characteristics. The Cr content is therefore in the range of 15.5% to 18.0%. The Cr content is preferably 16.0% or more. The Cr content is preferably 17.5% or less. The Cr content is further preferably 16.5% or more. The Cr content is further preferably 17.0% or less.

Ni: 0.01% to 1.0%

Ni has an effect of facilitating the generation of the austenite phase and expanding the dual phase temperature region where the ferrite phase and the austenite phase appear during annealing, as with C and Mn. To achieve this effect, the Ni content needs to be 0.01% or more. If the Ni content is more than 1.0%, workability decreases. The Ni content is therefore in the range of 0.01% to 1.0%. The Ni content is preferably 0.1% or more. The Ni content is preferably 0.6% or less. The Ni content is further preferably 0.1% or more. The Ni content is further preferably 0.4% or less.

Al: 0.001% to 0.10%

Al is an element that functions as a deoxidizer, as with Si. To achieve this effect, the Al content needs to be 0.001% or more. If the Al content is more than 0.10%, an Al inclusion such as $Al_2O_3$ increases, which is likely to cause lower surface characteristics. The Al content is therefore in the range of 0.001% to 0.10%. The Al content is preferably 0.001% or more. The Al content is preferably 0.05% or less. The Al content is further preferably 0.001% or more. The Al content is further preferably 0.03% or less.

N: 0.005% to 0.06%

N has an effect of facilitating the generation of the austenite phase and expanding the dual phase temperature region where the ferrite phase and the austenite phase appear during annealing, as with C and Mn. To achieve this effect, the N content needs to be 0.005% or more. If the N content is more than 0.06%, not only ductility decreases significantly, but also the precipitation of Cr nitride is promoted to cause lower corrosion resistance. The N content is therefore in the range of 0.005% to 0.06%. The N content is preferably 0.008% or more. The N content is preferably 0.045% or less. The N content is further preferably 0.010% or more. The N content is further preferably 0.020% or less.

While the basic components have been described above, the stainless steel according to the disclosure may contain the following elements as appropriate according to need, in order to improve manufacturability or material characteristics.

One or more selected from Cu: 0.1% to 1.0%, Mo: 0.1% to 0.5%, and Co: 0.01% to 0.5%

Cu: 0.1% to 1.0%, Mo: 0.1% to 0.5%

Cu and Mo are each an element that improves corrosion resistance, and is effectively contained particularly in the case where high corrosion resistance is required. Cu also has an effect of facilitating the generation of the austenite phase and expanding the dual phase temperature region where the ferrite phase and the austenite phase appear during annealing. The effect(s) is achieved when the Cu content or the Mo content is 0.1% or more. If the Cu content is more than 1.0%, hot workability may decrease, which is not preferable. Accordingly, in the case where Cu is contained, the Cu content is in the range of 0.1% to 1.0%. The Cu content is preferably 0.2% or more. The Cu content is preferably 0.8% or less. The Cu content is further preferably 0.3% or more. The Cu content is further preferably 0.5% or less. If the Mo content is more than 0.5%, the generation of the austenite phase during annealing is insufficient and predetermined material characteristics cannot be attained, which is not preferable. Accordingly, in the case where Mo is contained, the Mo content is in the range of 0.1% to 0.5%. The Mo content is preferably 0.2% or more. The Mo content is preferably 0.3% or less.

Co: 0.01% to 0.5%

Co is an element that improves toughness. This effect is achieved when the Co content is 0.01% or more. If the Co content is more than 0.5%, manufacturability decreases. Accordingly, in the case where Co is contained, the Co content is in the range of 0.01% to 0.5%. The Co content is further preferably 0.02% or more. The Co content is further preferably 0.20% or less.

One or more selected from V: 0.01% to 0.25%, Ti: 0.001% to 0.05%, Nb: 0.001% to 0.05%, Ca: 0.0002% to 0.0020%, Mg: 0.0002% to 0.0050%, B: 0.0002% to 0.0050%, and REM: 0.01% to 0.10%

V: 0.01% to 0.25%

V combines with C and N in the steel, and reduces solute C and N. This improves the mean r-value. V also improves surface characteristics, since it suppresses the precipitation of carbonitride in the hot rolled sheet and prevents the occurrence of linear flaws caused by hot rolling/annealing. To achieve these effects, the V content needs to be 0.01% or more. If the V content is more than 0.25%, workability decreases, and higher production cost is required. Accordingly, in the case where V is contained, the V content is in the range of 0.01% to 0.25%. The V content is preferably 0.03% or more. The V content is preferably 0.15% or less. The V content is further preferably 0.03% or more. The V content is further preferably 0.05% or less.

Ti: 0.001% to 0.05%, Nb: 0.001% to 0.05%

Ti and Nb are each an element that has an effect of improving workability after cold-rolled sheet annealing, since it has high affinity for C and N as with V, and have an effect of precipitating as carbide or nitride during hot rolling and reducing solute C and N in the matrix phase. To achieve this effect, the Ti content needs to be 0.001% or more, and the Nb content needs to be 0.001% or more. If the Ti content or the Nb content is more than 0.05%, the precipitation of excessive TiN or NbC makes it impossible to attain favorable surface characteristics. Accordingly, in the case where Ti is contained, the Ti content is in the range of 0.001% to 0.05%. In the case where Nb is contained, the Nb content is in the range of 0.001% to 0.05%. The Ti content is preferably 0.003% or more. The Ti content is preferably 0.010% or less. The Nb content is preferably 0.005% or more. The Nb content is preferably 0.020% or less. The Nb content is further preferably 0.010% or more. The Nb content is further preferably 0.015% or less.

Ca: 0.0002% to 0.0020%

Ca is an effective component to prevent a nozzle blockage caused by the crystallization of a Ti inclusion, which tends to occur during continuous casting. To achieve this effect, the Ca content needs to be 0.0002% or more. If the Ca content is more than 0.0020%, CaS forms and corrosion resistance decreases. Accordingly, in the case where Ca is contained, the Ca content is in the range of 0.0002% to 0.0020%. The Ca content is preferably 0.0005% or more. The Ca content is preferably 0.0015% or less. The Ca content is further preferably 0.0005% or more. The Ca content is further preferably 0.0010% or less.

Mg: 0.0002% to 0.0050%

Mg is an element that has an effect of improving hot workability. To achieve this effect, the Mg content needs to be 0.0002% or more. If the Mg content is more than 0.0050%, surface quality decreases. Accordingly, in the case where Mg is contained, the Mg content is in the range of 0.0002% to 0.0050%. The Mg content is preferably 0.0005% or more. The Mg content is preferably 0.0035% or less. The Mg content is further preferably 0.0005% or more. The Mg content is further preferably 0.0020% or less.

B: 0.0002% to 0.0050%

B is an element effective in preventing low-temperature secondary working embrittlement. To achieve this effect, the B content needs to be 0.0002% or more. If the B content is more than 0.0050%, hot workability decreases. Accordingly, in the case where B is contained, the B content is in the range of 0.0002% to 0.0050%. The B content is preferably 0.0005% or more. The B content is preferably 0.0035% or less. The B content is further preferably 0.0005% or more. The B content is further preferably 0.0020% or less.

REM: 0.01% to 0.10%

REM (Rare Earth Metals) is an element that improves oxidation resistance, and especially has an effect of suppressing oxide layer formation in a weld and improving the corrosion resistance of the weld. To achieve this effect, the REM content needs to be 0.01% or more. If the REM content is more than 0.10%, manufacturability such as pickling property during cold rolling and annealing decreases. Besides, since REM is an expensive element, excessively adding REM incurs higher production cost, which is not preferable. Accordingly, in the case where REM is contained, the REM content is in the range of 0.01% to 0.10%.

The chemical composition of the stainless steel according to the disclosure has been described above.

In the chemical composition according to the disclosure, components other than those described above are Fe and incidental impurities.

The following describes a method for producing the stainless steel according to the disclosure.

Molten steel having the aforementioned chemical composition is obtained by steelmaking using a known method such as a converter, an electric heating furnace, or a vacuum melting furnace, and made into a steel raw material (slab) by continuous casting or ingot casting and blooming. The slab is heated at 1100° C. to 1250° C. for 1 hours to 24 hours and then hot rolled, or the cast slab is directly hot rolled without heating, into a hot rolled sheet.

The hot rolled sheet is then subjected to hot-rolled sheet annealing of holding the hot rolled sheet at a temperature of 900° C. or more and 1050° C. or less which is a dual phase region temperature of the ferrite phase and the austenite phase for 5 seconds to 15 minutes, to form a hot-rolled and annealed sheet. Next, the hot-rolled and annealed sheet is pickled according to need, and then cold rolled into a cold rolled sheet. After this, the cold rolled sheet is subjected to cold-rolled sheet annealing, to form a cold-rolled and annealed sheet. The cold-rolled and annealed sheet is pickled according to need, to form a product.

Cold rolling is preferably performed at a rolling reduction of 50% or more, in terms of elongation property, bendability, press formability, and shape adjustment. In the disclosure, cold rolling and annealing may be performed twice or more. Cold-rolled sheet annealing is performed by holding the cold rolled sheet at a temperature of 850° C. or more and 950° C. or less for 5 seconds to 5 minutes. BA annealing (bright annealing) may be performed to enhance brightness.

Moreover, grinding, polishing, etc. may be applied to further improve surface characteristics.

The reasons for limiting the hot-rolled sheet annealing condition and the cold-rolled sheet annealing condition from among the aforementioned production conditions are described below.

Hot-rolled sheet annealing condition: holding the hot rolled sheet at a temperature of 900° C. or more and 1050° C. or less for 5 seconds to 15 minutes Hot-rolled sheet annealing is a very important step to attain excellent formability and ridging resistance in the disclosure. If the holding temperature in the hot-rolled sheet annealing is less than 900° C., recrystallization is insufficient, and also the phase region is the ferrite single phase region, which may make it impossible to achieve the advantageous effects of the disclosure produced by dual phase region annealing. If the holding temperature is more than 1050° C., the volume fraction of the martensite phase generated after the hot-rolled sheet annealing decreases, as a result of which the concentration effect of the rolling strain in the ferrite phase in the subsequent cold rolling is reduced. This causes insufficient ferrite colony destruction, so that predetermined ridging resistance may be unable to be attained.

If the holding time is less than 5 seconds, the generation of the austenite phase and the recrystallization of the ferrite phase are insufficient even when the annealing is performed at the predetermined temperature, so that desired formability may be unable to be attained. If the holding time is more than 15 minutes, the concentration of C in the austenite phase is promoted, which may cause excessive martensite phase generation after the hot-rolled sheet annealing and result in a decrease in hot rolled sheet toughness. The hot-rolled sheet annealing therefore holds the hot rolled sheet at a temperature of 900° C. or more and 1050° C. or less for 5 seconds to 15 minutes. The hot-rolled sheet annealing preferably holds the hot rolled sheet at a temperature of 920° C. or more and 1030° C. or less for 15 seconds to 3 minutes.

Cold-rolled sheet annealing condition: holding the cold rolled sheet at a temperature of 850° C. or more and 950° C. or less for 5 seconds to 5 minutes Cold-rolled sheet annealing is an important step to recrystallize the ferrite phase generated in the hot-rolled sheet annealing and also adjust the volume fraction of the martensite phase in the steel sheet after final annealing to a predetermined range. If the holding temperature in the cold-rolled sheet annealing is less than 850° C., recrystallization is insufficient and predetermined mean El and mean r-value cannot be attained. If the holding temperature is more than 950° C., the martensite phase is generated excessively and the steel sheet hardens, and as a result predetermined mean El cannot be attained.

If the holding time is less than 5 seconds, the recrystallization of the ferrite phase is insufficient even when the annealing is performed at the predetermined temperature, so that predetermined mean El and mean r-value cannot be attained. If the holding time is more than 5 minutes, crystal grains coarsen significantly and the brightness of the steel sheet decreases, which is not preferable in terms of surface quality. The cold-rolled sheet annealing therefore holds the cold rolled sheet at a temperature of 850° C. or more and 950° C. or less for 5 seconds to 5 minutes. The cold-rolled sheet annealing preferably holds the cold rolled sheet at a temperature of 880° C. or more and 940° C. or less for 15 seconds to 3 minutes.

EXAMPLES

Each steel whose chemical composition is shown in Table 1 was obtained by steelmaking in a 50 kg small vacuum melting furnace. After heating each steel ingot at 1150° C. for 1 h, the steel ingot was hot rolled into a hot rolled sheet of 3.0 mm in thickness. After the hot rolling, the hot rolled sheet was water cooled to 600° C. and then air cooled. Following this, the hot rolled sheet was subjected to hot-rolled sheet annealing under the condition shown in Table 2, and then descaling was performed on its surface by shot blasting and pickling. The hot rolled sheet was further cold rolled to 0.8 mm in sheet thickness. The cold rolled sheet was subjected to cold-rolled sheet annealing under the condition shown in Table 2, and then descaled by pickling to obtain a cold-rolled and annealed sheet.

The cold-rolled and annealed sheet was evaluated as follows.

(1) Microstructure Observation

Volume Fraction of Martensite Phase

A test piece for cross-sectional observation was made from the cold-rolled and annealed sheet, etched with aqua regia, and then observed using an optical microscope. After distinguishing the martensite phase and the ferrite phase from each other based on the microstructure shape and the etching strength, the volume fraction of the martensite phase was calculated by image processing. The observation was performed for 10 observation fields at 100 magnifications, and the mean value was set as the volume fraction of the martensite phase. The microstructure other than the martensite phase was the ferrite phase.

(2) Evaluation of Formability

Mean Elongation After Fracture (Mean El) and In-Plane Anisotropy of Elongation After Fracture |ΔEl|

A JIS No. 13B tensile test piece was collected from the cold-rolled and annealed sheet so that the longitudinal direction of the test piece was each of the rolling direction (L direction), the direction of 45° to the rolling direction (D direction), and the direction orthogonal to the rolling direction (C direction). A tensile test was conducted according to JIS Z 2241, to measure the elongation after fracture.

The mean elongation after fracture (mean El) was then calculated using the following expression, and each test piece with mean El of 25% or more was accepted and each test piece with mean El of less than 25% was rejected:

$$\text{mean } El=(El_L+2\times El_D+El_C)/4.$$

Next, |ΔEl| was calculated using the following expression, and each test piece with |ΔEl| of 3.0% or less was accepted and each test piece with |ΔEl| of more than 3.0% was rejected:

$$|\Delta El|=|(El_L-2\times El_D+El_C)/2|.$$

Mean R-Value and In-Plane Anisotropy of R-Value |Δr|

A JIS No. 13B tensile test piece was collected from the cold-rolled and annealed sheet so that the longitudinal direction of the test piece was each of the rolling direction (L direction), the direction of 45° to the rolling direction (D direction), and the direction orthogonal to the rolling direction (C direction). The r-values ($r_L$, $r_D$, $r_C$) in the respective directions in the case of adding a strain of 15% in a tensile test according to JIS Z 2241 were calculated. Here, $r_L$, $r_D$, and $r_C$ are respectively the mean Lankford values (mean r-values) in L direction, D direction, and C direction.

The mean r-value was then calculated using the following expression, and each test piece with mean r-value of 0.70 or more was accepted and each test piece with mean r-value of less than 0.70 was rejected:

$$\text{mean } r\text{-value}=(r_L+2\times r_D+r_C)/4.$$

Next, |Δr| was calculated using the following expression, and each test piece with |Δr| of 0.30 or less was accepted and each test piece with |Δr| of more than 0.30 was rejected:

$$|\Delta r|=|(r_L-2\times r_D+r_C)/2|.$$

(3) Evaluation of Ridging Resistance

A JIS No. 5 tensile test piece was collected from the cold-rolled and annealed sheet so that the rolling direction was the longitudinal direction of the test piece. After polishing the surface using #600 emery paper, a tensile test was conducted according to JIS Z 2241, and a tensile strain of 20% was added. The arithmetic mean waviness Wa defined in JIS B 0601 (2001) was then measured by a surface roughness meter on the polished surface at the center of the parallel portion of the test piece in the direction orthogonal to the rolling direction, with a measurement length of 16 mm, a high-cut filter wavelength of 0.8 mm, and a low-cut filter wavelength of 8 mm. Each test piece with Wa of 2.0 μm or less was accepted (good) as having good ridging resistance, each test piece with Wa of more than 2.0 μm and 2.5 μm or less was accepted (fair), and each test piece with Wa of more than 2.5 μm was rejected.

(4) Evaluation of Corrosion Resistance

A test piece of 60 mm×100 mm was collected from the cold-rolled and annealed sheet. After polishing the surface using #600 emery paper, the end surface part of the test piece was sealed, and the test piece was subjected to a salt spray cycle test defined in JIS H 8502. The salt spray cycle test was performed eight cycles each of which involved salt spray (5 mass % NaCl, 35° C., spray 2 h)→dry (60° C., 4 h, relative humidity of 40%)→wet (50° C., 2 h, relative humidity≥95%).

The test piece surface after eight cycles of the salt spray cycle test was photographed, the rusting area of the test piece surface was measured by image analysis, and the rusting ratio ((the rusting area in the test piece)/(the whole area of the test piece)×100%) was calculated from the ratio to the whole area of the test piece. Each test piece with a rusting ratio of 10% or less was accepted (good) as having good corrosion resistance, each test piece with a rusting ratio of more than 10% and 25% or less was accepted (fair), and each test piece with a rusting ratio of more than 25% was rejected.

The evaluation results of the foregoing (1) to (4) are shown in Table 2.

TABLE 1

| | Chemical composition (mass %) | | | | | | | | | | |
|---|---|---|---|---|---|---|---|---|---|---|---|
| Steel ID | C | Si | Mn | P | S | Cr | Ni | Al | N | Others | Remarks |
| AA | 0.023 | 0.10 | 0.81 | 0.020 | 0.002 | 16.2 | 0.11 | 0.005 | 0.035 | — | Conforming steel |
| AB | 0.021 | 0.16 | 0.24 | 0.020 | 0.001 | 16.3 | 0.15 | 0.010 | 0.050 | — | Conforming steel |
| AC | 0.025 | 0.30 | 0.10 | 0.020 | 0.003 | 16.1 | 0.25 | 0.007 | 0.025 | V: 0.05, Cu: 0.32 | Conforming steel |
| AD | 0.022 | 0.46 | 0.39 | 0.020 | 0.009 | 16.6 | 0.26 | 0.004 | 0.027 | — | Conforming steel |
| AE | 0.020 | 0.71 | 0.12 | 0.030 | 0.002 | 17.4 | 0.15 | 0.007 | 0.055 | Mo: 0.21 | Conforming steel |
| AF | 0.012 | 0.32 | 0.09 | 0.010 | 0.006 | 16.8 | 0.38 | 0.004 | 0.024 | — | Conforming steel |
| AG | 0.006 | 0.51 | 0.50 | 0.030 | 0.007 | 16.1 | 0.55 | 0.004 | 0.013 | — | Conforming steel |
| AH | 0.040 | 0.25 | 0.70 | 0.010 | 0.003 | 16.7 | 0.29 | 0.006 | 0.058 | — | Conforming steel |
| AI | 0.042 | 0.27 | 0.65 | 0.010 | 0.006 | 16.6 | 0.45 | 0.015 | 0.050 | Ti: 0.011, Nb: 0.020 | Conforming steel |
| AJ | 0.041 | 0.23 | 0.71 | 0.030 | 0.008 | 17.2 | 0.47 | 0.015 | 0.037 | Ti: 0.022, Ca: 0.0011 | Conforming steel |
| AK | 0.033 | 0.31 | 0.45 | 0.020 | 0.004 | 17.8 | 0.08 | 0.006 | 0.044 | Mg: 0.0025, B: 0.0010 | Conforming steel |
| AL | 0.022 | 0.50 | 0.31 | 0.030 | 0.008 | 15.7 | 0.26 | 0.013 | 0.039 | REM: 0.01 | Conforming steel |
| AM | 0.023 | 0.71 | 0.10 | 0.010 | 0.005 | 17.0 | 0.49 | 0.002 | 0.040 | V: 0.03, B: 0.0005 | Conforming steel |

TABLE 1-continued

| Steel ID | Chemical composition (mass %) | | | | | | | | | | Remarks |
|---|---|---|---|---|---|---|---|---|---|---|---|
| | C | Si | Mn | P | S | Cr | Ni | Al | N | Others | |
| AN | 0.021 | 0.15 | 0.079 | 0.020 | 0.004 | 16.9 | 0.21 | 0.027 | 0.040 | Co: 0.35 | Conforming steel |
| AO | 0.014 | 0.15 | 0.81 | 0.021 | 0.004 | 16.1 | 0.11 | 0.003 | 0.015 | — | Conforming steel |
| AP | 0.010 | 0.16 | 0.79 | 0.020 | 0.004 | 16.3 | 0.12 | 0.003 | 0.010 | — | Conforming steel |
| AQ | 0.007 | 0.15 | 0.79 | 0.020 | 0.005 | 16.2 | 0.12 | 0.004 | 0.006 | — | Conforming steel |
| AR | 0.015 | 0.16 | 0.80 | 0.021 | 0.004 | 16.2 | 0.11 | 0.004 | 0.016 | Ti: 0.007, Nb: 0.018 | Conforming steel |
| AS | 0.015 | 0.15 | 0.78 | 0.020 | 0.005 | 16.1 | 0.10 | 0.004 | 0.015 | Cu: 0.29, V: 0.05 | Conforming steel |
| BA | 0.061 | 0.42 | 0.20 | 0.020 | 0.007 | 16.2 | 0.36 | 0.002 | 0.049 | — | Comparative steel |
| BB | 0.025 | 0.71 | 0.21 | 0.020 | 0.003 | 18.5 | 0.21 | 0.018 | 0.041 | — | Comparative steel |
| BC | 0.024 | 0.20 | 0.80 | 0.030 | 0.002 | 15.3 | 0.25 | 0.002 | 0.048 | — | Comparative steel |

Note:
underlined value is outside the appropriate range.

TABLE 2

| No. | Steel ID | Hot-rolled sheet annealing condition | | Cold-rolled sheet annealing condition | | Volume fraction of martensite phase (%) | Formability Mean El |
|---|---|---|---|---|---|---|---|
| | | Holding temperature (° C.) | Holding time (sec) | Holding temperature (° C.) | Holding time (sec) | | |
| 1 | AA | 935 | 60 | 880 | 20 | 4 | Accepted |
| 2 | AB | 940 | 60 | 900 | 20 | 3 | Accepted |
| 3 | AC | 945 | 60 | 880 | 20 | 3 | Accepted |
| 4 | AD | 940 | 60 | 865 | 20 | 2 | Accepted |
| 5 | AE | 940 | 60 | 870 | 20 | 1 | Accepted |
| 6 | AF | 940 | 60 | 880 | 20 | 3 | Accepted |
| 7 | AG | 935 | 60 | 875 | 20 | 4 | Accepted |
| 8 | AH | 940 | 60 | 900 | 20 | 5 | Accepted |
| 9 | AI | 945 | 60 | 920 | 20 | 9 | Accepted |
| 10 | AJ | 940 | 60 | 880 | 20 | 4 | Accepted |
| 11 | AK | 940 | 60 | 880 | 20 | 4 | Accepted |
| 12 | AL | 940 | 60 | 860 | 20 | 3 | Accepted |
| 13 | AM | 950 | 60 | 865 | 20 | 2 | Accepted |
| 14 | AN | 940 | 60 | 880 | 20 | 3 | Accepted |
| 15 | AO | 940 | 60 | 880 | 20 | 3 | Accepted |
| 16 | AP | 940 | 60 | 880 | 20 | 2 | Accepted |
| 17 | AQ | 940 | 60 | 880 | 20 | 1 | Accepted |
| 18 | AR | 940 | 60 | 880 | 20 | 2 | Accepted |
| 19 | AS | 940 | 60 | 880 | 20 | 2 | Accepted |
| 20 | BA | 940 | 60 | 860 | 20 | 5 | Rejected |
| 21 | BB | 940 | 60 | 860 | 20 | 0 | Accepted |
| 22 | BC | 940 | 60 | 860 | 20 | 8 | Accepted |
| 23 | AA | 880 | 60 | 840 | 20 | 0 | Accepted |
| 24 | AA | 1080 | 60 | 840 | 20 | 0 | Accepted |
| 25 | AA | 935 | 60 | 780 | 20 | 0 | Rejected |
| 26 | AA | 935 | 60 | 980 | 20 | 15 | Rejected |

| No. | Formability | | | Ridging resistance | Corrosion resistance | Remarks |
|---|---|---|---|---|---|---|
| | \|ΔEl\| | Mean r-value | \|Δr\| | | | |
| 1 | Accepted | Accepted | Accepted | Accepted (good) | Accepted (fair) | Example |
| 2 | Accepted | Accepted | Accepted | Accepted (good) | Accepted (fair) | Example |
| 3 | Accepted | Accepted | Accepted | Accepted (good) | Accepted (good) | Example |
| 4 | Accepted | Accepted | Accepted | Accepted (fair) | Accepted (fair) | Example |
| 5 | Accepted | Accepted | Accepted | Accepted (fair) | Accepted (good) | Example |
| 6 | Accepted | Accepted | Accepted | Accepted (fair) | Accepted (fair) | Example |
| 7 | Accepted | Accepted | Accepted | Accepted (fair) | Accepted (fair) | Example |
| 8 | Accepted | Accepted | Accepted | Accepted (good) | Accepted (fair) | Example |
| 9 | Accepted | Accepted | Accepted | Accepted (fair) | Accepted (fair) | Example |
| 10 | Accepted | Accepted | Accepted | Accepted (fair) | Accepted (fair) | Example |
| 11 | Accepted | Accepted | Accepted | Accepted (fair) | Accepted (good) | Example |
| 12 | Accepted | Accepted | Accepted | Accepted (good) | Accepted (fair) | Example |
| 13 | Accepted | Accepted | Accepted | Accepted (fair) | Accepted (fair) | Example |
| 14 | Accepted | Accepted | Accepted | Accepted (fair) | Accepted (fair) | Example |
| 15 | Accepted | Accepted | Accepted | Accepted (fair) | Accepted (good) | Example |
| 16 | Accepted | Accepted | Accepted | Accepted (fair) | Accepted (good) | Example |
| 17 | Accepted | Accepted | Accepted | Accepted (fair) | Accepted (good) | Example |
| 18 | Accepted | Accepted | Accepted | Accepted (fair) | Accepted (good) | Example |
| 19 | Accepted | Accepted | Accepted | Accepted (fair) | Accepted (good) | Example |
| 20 | Accepted | Accepted | Accepted | Accepted (fair) | Rejected | Comparative Example |
| 21 | Rejected | Accepted | Rejected | Rejected | Accepted (good) | Comparative Example |

TABLE 2-continued

| | | | | | | |
|---|---|---|---|---|---|---|
| 22 | Accepted | Accepted | Accepted | Accepted (fair) | Rejected | Comparative Example |
| 23 | Rejected | Accepted | Rejected | Rejected | Accepted (fair) | Comparative Example |
| 24 | Rejected | Rejected | Rejected | Rejected | Accepted (fair) | Comparative Example |
| 25 | Rejected | Rejected | Rejected | Rejected | Accepted (fair) | Comparative Example |
| 26 | Accepted | Rejected | Accepted | Accepted (fair) | Accepted (fair) | Comparative Example |

Note:
underlined value is outside the appropriate range.

As shown in Table 2, all Examples were excellent in formability and ridging resistance and also excellent in corrosion resistance.

In particular, in No. 3 (steel AC) with Cu content of 0.32%, No. 5 (steel AE) with Mo content of 0.21%, No. 11 (steel AK) with Cr content of 17.8%, and No. 15 to No. 19 (steel AO to AS) with N content being limited to 0.020% or less, the rusting ratio after the salt spray cycle test was 10% or less, indicating improved corrosion resistance.

In No. 20 (steel BA) with C content above the appropriate range, predetermined mean El and anti-corrosion property were not attained. In No. 21 (steel BB) with Cr content above the appropriate range, the volume fraction of the martensite phase was below the appropriate range, and so predetermined |ΔEl|, |Δr|, and ridging resistance were not attained. In No. 22 (steel BC) with Cr content below the appropriate range, predetermined anti-corrosion property was not attained.

In No. 23 (steel AA) with the holding temperature in the hot-rolled sheet annealing below the appropriate range, the volume fraction of the martensite phase was below the appropriate range, and so predetermined |ΔEl|, |Δr|, and ridging resistance were not attained. In No. 24 (steel AA) with the holding temperature in the hot-rolled sheet annealing above the appropriate range, the volume fraction of the martensite phase was below the appropriate range, and so predetermined |ΔEl|, mean r-value, |Δr|, and ridging resistance were not attained. In No. 25 (steel AA) with the holding temperature in the cold-rolled sheet annealing below the appropriate range, recrystallization was insufficient, and so predetermined mean El, |ΔEl|, mean r-value, |Δr|, and ridging resistance were not attained. In No. 26 (steel AA) with the holding temperature in the cold-rolled sheet annealing above the appropriate range, the volume fraction of the martensite phase was above the appropriate range, and so predetermined mean El and mean r-value were not attained.

These results demonstrate that stainless steel having excellent ridging resistance and formability and also having excellent corrosion resistance can be obtained according to the disclosure.

INDUSTRIAL APPLICABILITY

The stainless steel according to the disclosure is particularly suitable for press formed parts mainly made by bulging or drawing and other uses where high surface aesthetics is required, such as kitchen utensils and eating utensils.

The invention claimed is:

1. A stainless steel comprising:

a chemical composition consisting of, in mass %,

C: 0.005% to 0.050%,

Si: 0.01% to 1.00%,

Mn: 0.01% to 1.0%,

P: 0.040% or less,

S: 0.010% or less,

Cr: 15.5% to 18.0%,

Ni: 0.01% to 1.0%,

Al: 0.001% to 0.10%,

N: 0.005% to 0.06%, and optionally one or more selected from Cu: 0.1% to 1.0%, Mo: 0.1% to 0.5%, and Co: 0.01% to 0.5%, and one or more selected from V: 0.01% to 0.25%, Ti: 0.001% to 0.022%, Nb: 0.001% to 0.05%, Ca: 0.0002% to 0.0020%, Mg: 0.0002% to 0.0050%, B: 0.0002% to 0.0050%, and REM: 0.01% to 0.10%, with a balance being Fe and incidental impurities; and a microstructure containing a martensite phase of 1% to 10% in volume fraction with respect to a whole volume of the microstructure, wherein mean elongation after fracture is 25% or more, in-plane anisotropy of elongation after fracture |ΔEl| is 3% or less, mean Lankford value is 0.70 or more, in-plane anisotropy of Lankford value |Δr| is 0.30 or less, and ridging height is 2.5 μm or less.

2. A method for producing the stainless steel according to claim 1, the method comprising:

hot rolling a steel slab having the chemical composition according to claim 1 into a hot rolled sheet;

performing hot-rolled sheet annealing of holding the hot rolled sheet in a temperature range of 900° C. or more and 1050° C. or less for 5 seconds to 15 minutes, to form a hot-rolled and annealed sheet;

cold rolling the hot-rolled and annealed sheet into a cold rolled sheet; and performing cold-rolled sheet annealing of holding the cold rolled sheet in a temperature range of 850° C. or more and 950° C. or less for 5 seconds to 5 minutes.

* * * * *